US006703801B2

(12) United States Patent
Yoshinaga et al.

(10) Patent No.: US 6,703,801 B2
(45) Date of Patent: Mar. 9, 2004

(54) DEFLECTION YOKE AND COLOR CATHODE RAY TUBE DEVICE

(75) Inventors: Takahiko Yoshinaga, Osaka (JP); Kenichiro Taniwa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 125 days.

(21) Appl. No.: 10/004,678

(22) Filed: Dec. 4, 2001

(65) Prior Publication Data

US 2002/0067146 A1 Jun. 6, 2002

(30) Foreign Application Priority Data

Dec. 6, 2000 (JP) ..... 2000-370903

(51) Int. Cl.[7] ..... H01J 29/70
(52) U.S. Cl. ..... 315/399; 313/440
(58) Field of Search ..... 315/399, 370; 313/440, 431, 413, 421, 441; 335/210, 213, 296, 212

(56) References Cited

U.S. PATENT DOCUMENTS

| | | | | |
|---|---|---|---|---|
| 3,898,521 A | * | 8/1975 | Saito et al. | 315/370 |
| 4,553,120 A | | 11/1985 | Dam | 335/210 |
| 5,191,253 A | | 3/1993 | Kang | 313/440 |
| 5,453,658 A | | 9/1995 | Nishino et al. | 313/440 |
| 5,786,661 A | | 7/1998 | Kim | 313/440 |
| 5,880,660 A | | 3/1999 | Iwasaki et al. | 335/213 |
| 5,942,845 A | * | 8/1999 | Matsubara | 313/440 |
| 6,031,327 A | * | 2/2000 | Lee | 313/440 |
| 6,177,760 B1 | * | 1/2001 | Okawa et al. | 313/440 |
| 6,198,368 B1 | * | 3/2001 | Nam | 313/440 |

FOREIGN PATENT DOCUMENTS

| | | |
|---|---|---|
| EP | 0 139 326 | 5/1985 |
| EP | 0 435 602 | 7/1991 |
| GB | 2 342 225 | 4/2000 |
| JP | 5-11292 | 2/1993 |
| JP | P3128417 | 10/1994 |
| JP | 10-172473 | 6/1998 |
| JP | 10-188849 | 7/1998 |
| JP | 10-199446 | 7/1998 |
| JP | 2000-149818 | 5/2000 |

* cited by examiner

*Primary Examiner*—Don Wong
*Assistant Examiner*—Jimmy T. Vu
(74) *Attorney, Agent, or Firm*—Merchant & Gould, P.C.

(57) ABSTRACT

In a deflection yoke including a horizontal deflection coil, an insulation frame, a vertical deflection coil, and a ferrite core arranged in this order outwardly, on an outer wall of a minor diameter portion of the insulation frame, a plurality of elastic projections are provided that are arranged in a standing condition to hold an outer wall of a minor diameter portion of the ferrite core. The ferrite core thus can be held in an optimum position in a vertical axis direction. Preferably, the outer wall of the minor diameter portion of the ferrite core has a tapered portion having a diameter decreasing in a direction towards an end side of the minor diameter portion that is held by the elastic projections. The ferrite core thus can be held also in an optimum position in a tube axis direction. A color cathode ray tube device with reduced YH crossed misconvergence thus can be realized.

6 Claims, 9 Drawing Sheets

DEFLECTION YOKE AND COLOR CATHODE RAY TUBE DEVICE

BACKGROUND OF THE INVENTION

1. Field of the Invention

The present invention relates to a deflection yoke that is used for a color cathode ray tube of a television receiver, a computer display, or the like and a color cathode ray tube device using the deflection yoke.

2. Related Background Art

Generally, in a deflection yoke, magnetic intensity is highest in a minor diameter portion, and thus a positional shift of the minor diameter portion in a ferrite core of the deflection yoke has a great influence on convergence properties. As a solution to this, the following technique has been disclosed in JP 5 (1993)-11292 U.

As shown in FIGS. 5 and 7, a deflection yoke includes a horizontal deflection coil 1, an insulation frame 2, a vertical deflection coil 3, and a ferrite core 4 having the general shape of a surface of a conical frustum, respectively that are arranged in this order outwardly. In the insulation frame 2, a plurality of elastic projections 5 are formed on an outer wall 2*a* of a minor diameter portion that are arranged in a standing condition symmetrically with respect to each other. The plurality of elastic projections 5 are in contact with an inner wall 4*b* of a minor diameter portion of the ferrite core 4 to control a positional shift of the ferrite core 4 in a horizontal direction. For fixing of the ferrite core 4 to the insulation frame 2, a major diameter portion 2*b* of the insulation frame 2 and a major diameter portion 4*d* of the ferrite core 4 are fixed to each other by a hot-melt adhesive 6.

FIG. 6 shows a cross section of the deflection yoke perpendicular to a tube axis Z. As shown in FIG. 6, generally, the vertical deflection coil 3 is substantially circular at an inner face but is substantially elliptical at an outer face, having a major axis in a direction of a horizontal axis X. That is, the vertical deflection coil 3 has a thickness that is smaller on a vertical axis Y than on the horizontal axis X. This has been a cause of the formation of a gap δ2 in a direction of the vertical axis Y between an outer wall face of the vertical deflection coil 3 and the inner wall 4*b* of the minor diameter portion of the ferrite core 4.

In addition, when the ferrite core 4 is fitted to the insulation frame 2 in a process of assembling a deflection yoke, the following is observed. In the case where the inner wall 4*b* of the minor diameter portion of the ferrite core 4 has a tapered portion having a diameter decreasing in a direction towards an end side of the minor diameter portion as shown in FIG. 5, an elastic force exerted by the elastic projections 5 acts with respect to the tapered portion of the inner wall 4*b* of the minor diameter portion in a direction indicated by an arrow C that is oblique with respect to the tube axis Z. Similarly, in the case where end portions 5*a* of the elastic projections 5 are bent downward with respect to the inner wall 4*b* of the minor diameter portion of the ferrite core 4 as shown in FIG. 7, an elastic force exerted by the elastic projections 5 acts with respect to the inner wall 4*b* of the minor diameter portion in a direction indicated by an arrow C that is oblique with respect to a tube axis Z. Consequently, in both configurations described above, the elastic force exerted by the elastic projections 5 acts with respect to the ferrite core 4 in such a manner that the major diameter portion 4*d* of the ferrite core 4 is parted from the major diameter portion 2*b* of the insulation frame 2 in a direction of the tube axis Z. This has been a cause of the formation of a gap δ1 in the tube axis direction between the vertical deflection coil 3 and the ferrite core 4.

As a result, when the deflection yoke as described above is fitted to a color cathode ray tube, the ferrite core 4 is shifted in directions of a vertical axis Y and a tube axis Z of the color cathode ray tube and thus cannot be held in an optimum position, which has been disadvantageous. This has been a cause of the generation of YH crossed misconvergence as shown in FIG. 8, which adversely affects image quality.

SUMMARY OF THE INVENTION

This invention is intended to solve the problems as mentioned above. It is a first object of the present invention to provide a deflection yoke in which a ferrite core can be held in an optimum position in a vertical axis direction. Further, it is a second object of the present invention to provide a deflection yoke in which a ferrite core can be held in an optimum position in a tube axis direction as well as in a vertical axis direction. Still further, it is a third object of the present invention to provide a color cathode ray tube device that can inhibit the generation of YH crossed misconvergence by holding a ferrite core in a desired position.

A deflection yoke of the present invention includes a horizontal deflection coil, an insulation frame, a vertical deflection coil, and a ferrite core that are arranged in this order outwardly. On an outer wall of a minor diameter portion of the insulation frame, a plurality of elastic projections are provided that are arranged in a standing condition to hold an outer wall of a minor diameter portion of the ferrite core.

According to this configuration, a center of the ferrite core is controlled so as to be positioned on a tube axis by the plurality of elastic projections.

Preferably, in the aforementioned configuration, on the outer wall of the minor diameter portion of the ferrite core, a tapered portion having a diameter decreasing in a direction towards an end side of the minor diameter portion is provided and held by the elastic projections.

According to this configuration, when the ferrite core is fitted to the insulation frame in an assembling process, the elastic projections apply an elastic pressing force in an oblique direction with respect to a tube axis direction to a surface of the tapered portion. Accordingly, a component of the elastic pressing force in the tube axis direction acts in such a manner that a major diameter portion of the ferrite core is pressed to a side of a major diameter portion of the insulation frame in the tube axis direction. This allows a position of the ferrite core in the tube axis direction to be controlled properly.

A color cathode ray tube device of the present invention includes the deflection yoke of the present invention as described above, thereby allowing the minor diameter portion of the ferrite core to be held in a desired position. Thus, an excellent image display in which the generation of YH crossed misconvergence is inhibited can be obtained.

DETAILED DESCRIPTION OF THE INVENTION

Hereinafter, the present invention will be described by way of an embodiment with reference to the appended drawings.

Figure 4:
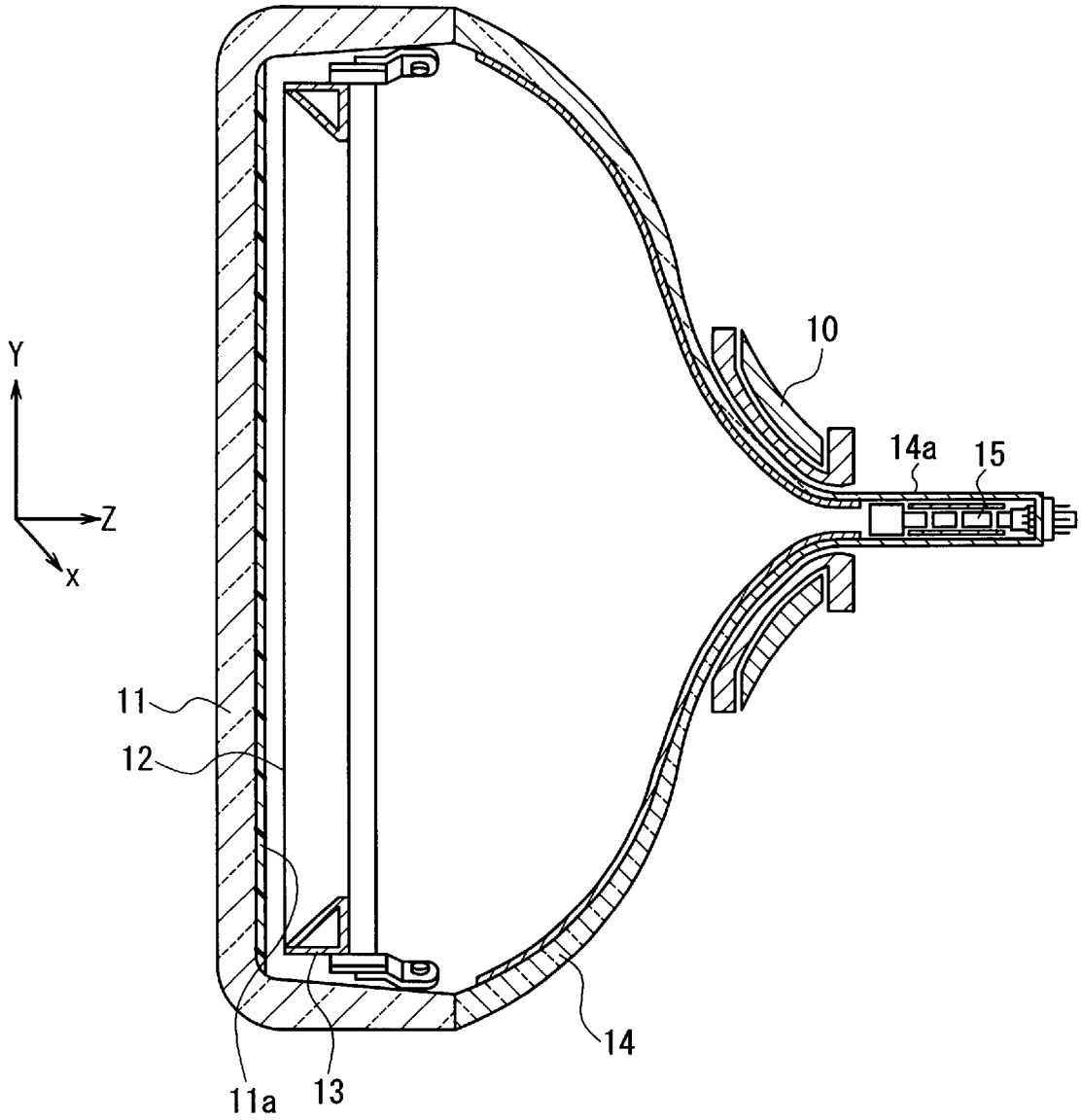
FIG. 4 is a cross-sectional view of a color cathode ray tube device according to the present invention.

As shown in FIG. 4, a color cathode ray tube device according to an embodiment of the present invention includes a color cathode ray tube and a deflection yoke 10, the color cathode ray tube being composed of a panel 11 having a phosphor screen 11*a*, a frame 13 having a shadow mask 12 provided in a position opposed to the phosphor screen 11*a*, and a funnel portion 14 having an electron gun 15 in a neck tube portion 14*a* and connecting the neck tube portion 14*a* and the panel 11. For convenience of the following description, as shown in the figure, a three-dimensional rectangular coordinate system of XYZ coordinates is set that is defined by a horizontal axis X in a horizontal direction perpendicular to a tube axis that intersects the tube axis, a vertical axis Y in a vertical direction perpendicular to the tube axis that intersects the tube axis, and a tube axis Z.

Figure 1:
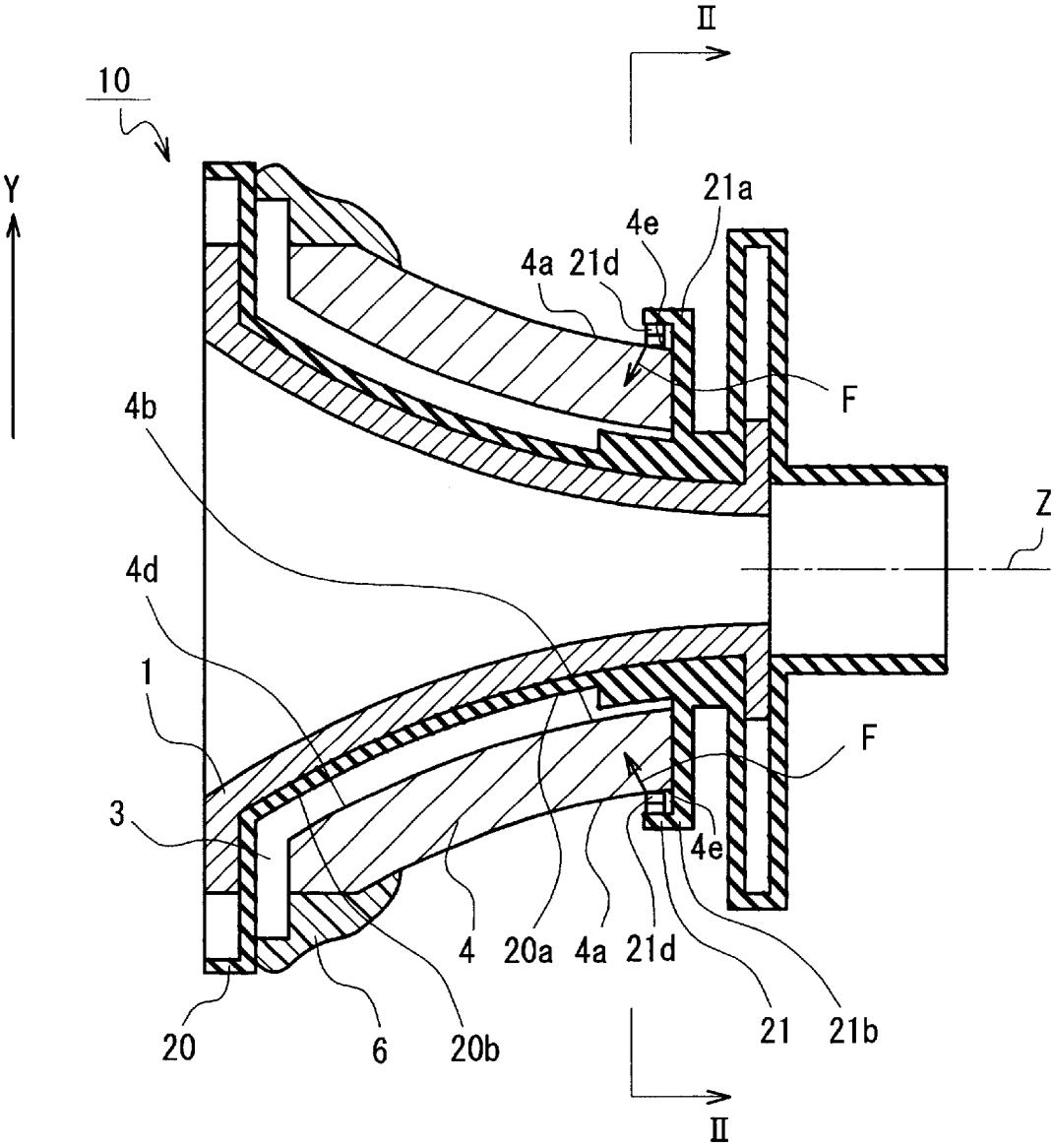
FIG. 1 is a cross-sectional view of a deflection yoke according to the present invention cut on a plane including a vertical axis and a tube axis.
Figure 2:
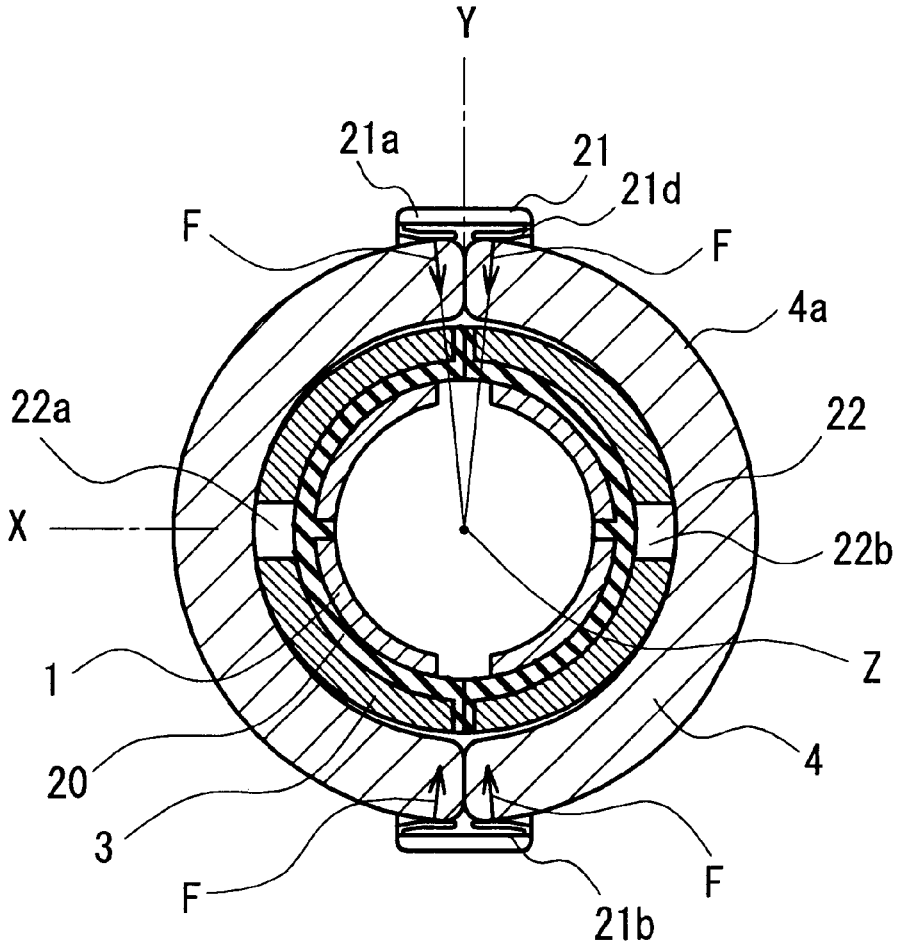
FIG. 2 is a cross-sectional view taken on line II—II of FIG. 1.

The deflection yoke 10 is provided on an outer periphery of the funnel portion 14 for deflecting electron beams emitted from the electron gun 15. As shown in FIG. 1, the deflection yoke 10 includes a horizontal deflection coil 1, an insulation frame 20, a vertical deflection coil 3, and a ferrite core 4 having the general shape of a surface of a conical frustum, respectively that are arranged in this order outwardly. A major diameter portion 20*b* of the insulation frame 2 and a major diameter portion 4*d* of the ferrite core 4 are fixed to each other by a hot-melt adhesive 6. As shown in FIG. 2, the ferrite core 4 is formed by combining a pair of half bodies divided into two by a plane including the vertical axis Y and the tube axis Z. On an outer wall 4*a* of a minor diameter portion of the ferrite core 4, a tapered portion 4*e* having a diameter decreasing in a direction towards an end side of the minor diameter portion is provided around the entire peripheral face.

In the insulation frame 20, a plurality of elastic projections 21 and a plurality of projections 22 are formed, respectively as shown in FIG. 2. The plurality of elastic projections 21 are arranged in a standing condition on an outer wall 20*a* of a minor diameter portion of the insulation frame 20 to hold the tapered portion 4*e* provided on the outer wall 4*a* of the minor diameter portion of the ferrite core 4. The plurality of projections 22 control a position of an inner wall 4*b* of the minor diameter portion of the ferrite core 4.

Figure 3:
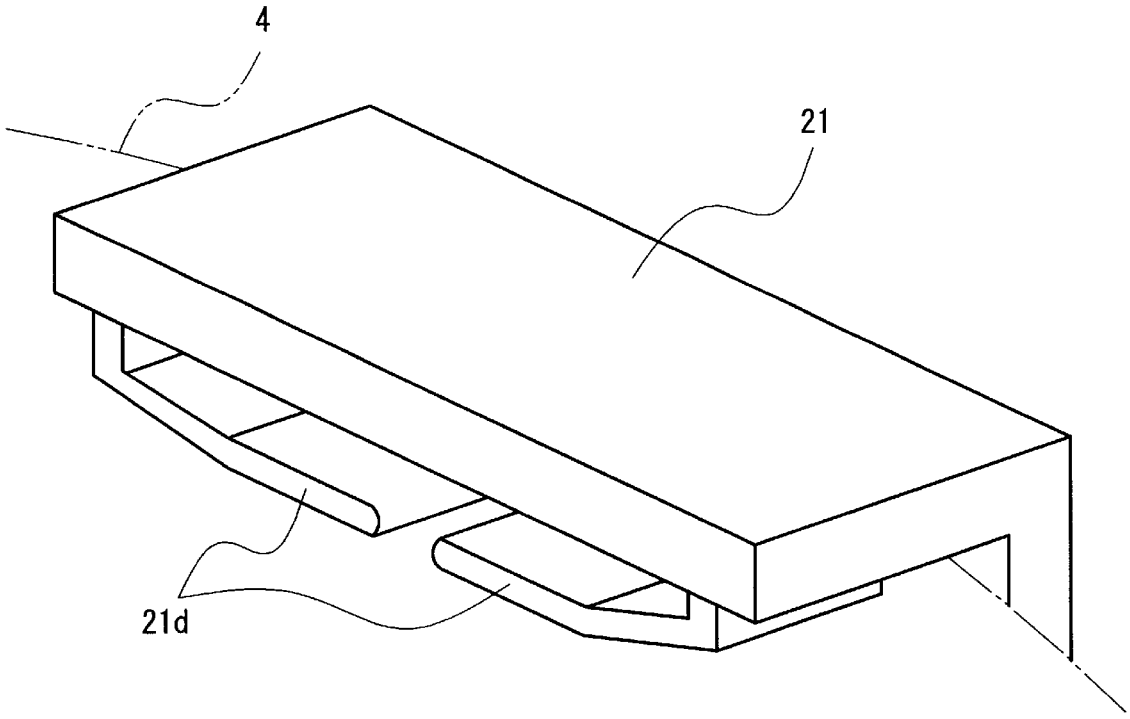
FIG. 3 is a perspective view showing a configuration of an end portion of an elastic projection of the deflection yoke according to the present invention.

FIG. 3 shows an end portion of each of the elastic projections 21. The plurality of the elastic projections 21 are intended to control a position of the ferrite core 4 so that a center of the ferrite core 4 is positioned on the tube axis Z. For example, in the end portion of each of the elastic projections 21, a pair of bent portions 21*d* are formed that elastically hold the tapered portion 4*e* on the outer wall 4*a* of the minor diameter portion of the ferrite core 4. The bent portions 21*d* are formed of bend-shaped resin leaf springs molded integrally with each of the elastic projections 21 and pressed into contact with the tapered portion 4*e* on the outer wall 4*a* of the minor diameter portion of the ferrite core 4. As shown in FIG. 2, the pair of bent portions 21*d* are pressed against each of the pair of half bodies constituting the ferrite core 4, respectively. The pair of bent portions 21*d* are formed so that in each of the pair of half bodies, an elastic pressing force F exerted on the tapered portion 4*e* is directed towards the tube axis Z in a plane orthogonal to the tube axis Z.

The elastic projections 21 are formed of a pair of elastic projections 21*a* and 21*b* arranged symmetrically with respect to a plane including the horizontal axis X and the tube axis Z when the deflection yoke 10 is fitted to the color cathode ray tube. This allows a positional shift of the ferrite core 4 in a direction of the vertical axis Y to be controlled.

The projections 22 may include a pair of projections 22*a* and 22*b* arranged symmetrically with respect to a plane including the vertical axis Y and the tube axis Z when the deflection yoke 10 is fitted to the color cathode ray tube. The projections 22 are in contact with inner walls of the pair of half bodies constituting the ferrite core 4, respectively. This allows a positional shift of the ferrite core 4 in a direction of the horizontal axis X to be controlled.

In the above description, the elastic projections 21 and the projections 22 are formed of the pair of elastic projections 21*a* and 21*b* provided on the vertical axis Y and the pair of projections 22*a* and 22*b* provided on the horizontal axis X, respectively. However, the positions for and the number of the elastic projections 21 and the projections 22 are not limited thereto. In the case where the ferrite core 4 is divided, for example, into three or four in a peripheral direction, the elastic projections 21 and the projections 22 may be provided so as to correspond to the number of sections forming the ferrite core 4. That is, the elastic projections 21 may be provided in positions where the ferrite core 4 is divided, respectively and the projections 22 may be provided so as to be opposed to each section of the core, respectively.

Furthermore, in the above description, the tapered portion 4*e* is provided throughout a periphery of the outer wall 4*a* of the minor diameter portion of the ferrite core 4. However, the present invention is not limited to this configuration. The tapered portion 4*e* may be provided only in portions to be brought into contact with the elastic projections 21, namely, at least in portions to be brought into contact with the elastic projections 21.

Furthermore, the elastic projections 21 may have a configuration different from a configuration including the bent portions 21*d* as described above or a configuration without the bent portions 21 as long as the elastic projections 21 can apply an elastic pressing force as described above to the outer wall 4*a* of the minor diameter portion of the ferrite core 4

The following description is directed to an operation and effects of the deflection yoke configured as described above.

In the deflection yoke 10 of the present invention, the plurality of elastic projections 21*a* and 21*b* are formed that are arranged in a standing condition on the outer wall 20*a* of the minor diameter portion of the insulation frame 20 to hold the outer wall 4*a* of the minor diameter portion of the ferrite core 4. Since the outer wall 4*a* of the minor diameter portion of the ferrite core 4 has the tapered portion 4*e*, when the ferrite core 4 is fitted to the insulation frame 20 in an assembling process, an elastic pressing force F exerted by each of the elastic projections 21*a* and 21*b* acts with respect to the tapered portion 4*e* of the outer wall 4*a* of the minor diameter portion in an oblique direction with respect to the tube axis Z as shown in FIG. 1. The major diameter portion 4*d* of the ferrite core 4 is pressed to a side of the major diameter portion 20*b* of the insulation frame 20 by a component of the elastic pressing force F in a direction parallel to a direction of the tube axis Z, so that the position of the ferrite core 4 in the direction of the tube axis Z is controlled. Further, the center of the ferrite core 4 is controlled in a direction of the vertical axis Y so as to be positioned on the tube axis Z by a component of the elastic pressing force F in a direction orthogonal to the tube axis Z. Thus, in the deflection yoke 10 of the present invention, the position of the ferrite core 4 in the direction of the tube axis Z and the position of the center of the ferrite core 4 can be held in optimum positions simply by the plurality of elastic projections 21*a* and 21*b* that are provided on the insulation frame and arranged in a standing condition. As a result, the configuration of the deflection yoke 10 can be simplified and YH crossed misconvergence can be reduced when the deflection yoke 10 is fitted to the color cathode ray tube.

Figure 5:
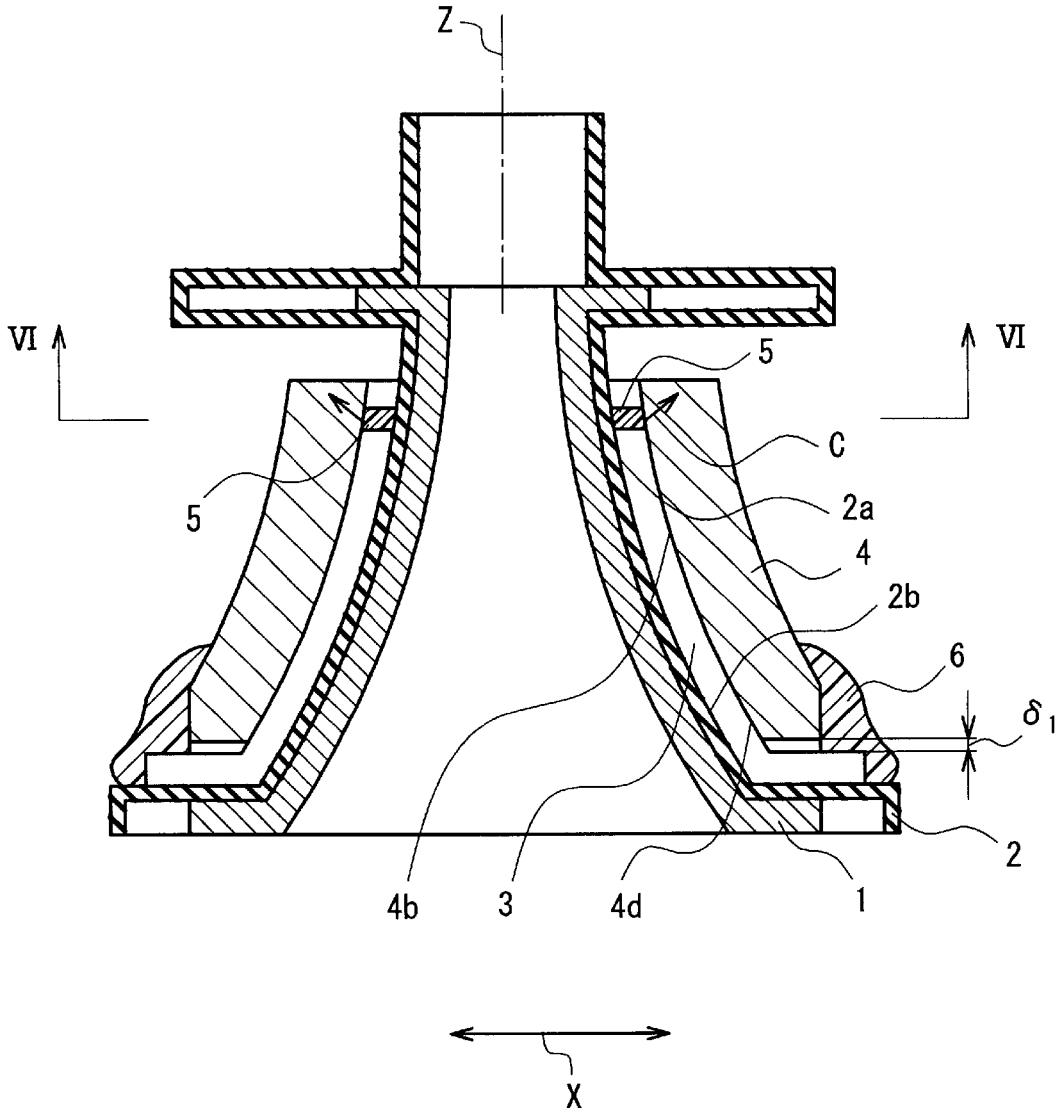
FIG. 5 (PRIOR ART)
FIG. 5 is a cross-sectional view of a conventional deflection yoke cut on a plane including a horizontal axis and a tube axis.
Figure 6:
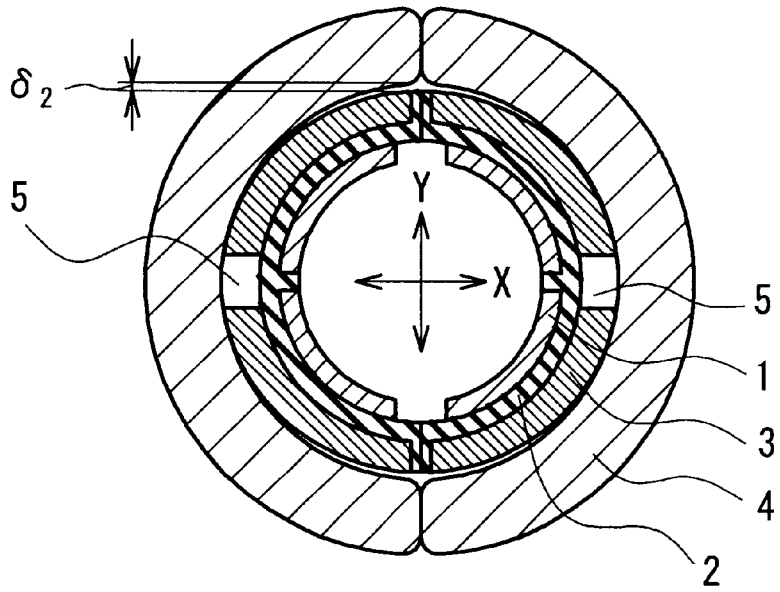
FIG. 6 (PRIOR ART)
FIG. 6 is a cross-sectional view taken on line VI—VI of FIG. 5.
Figure 7:
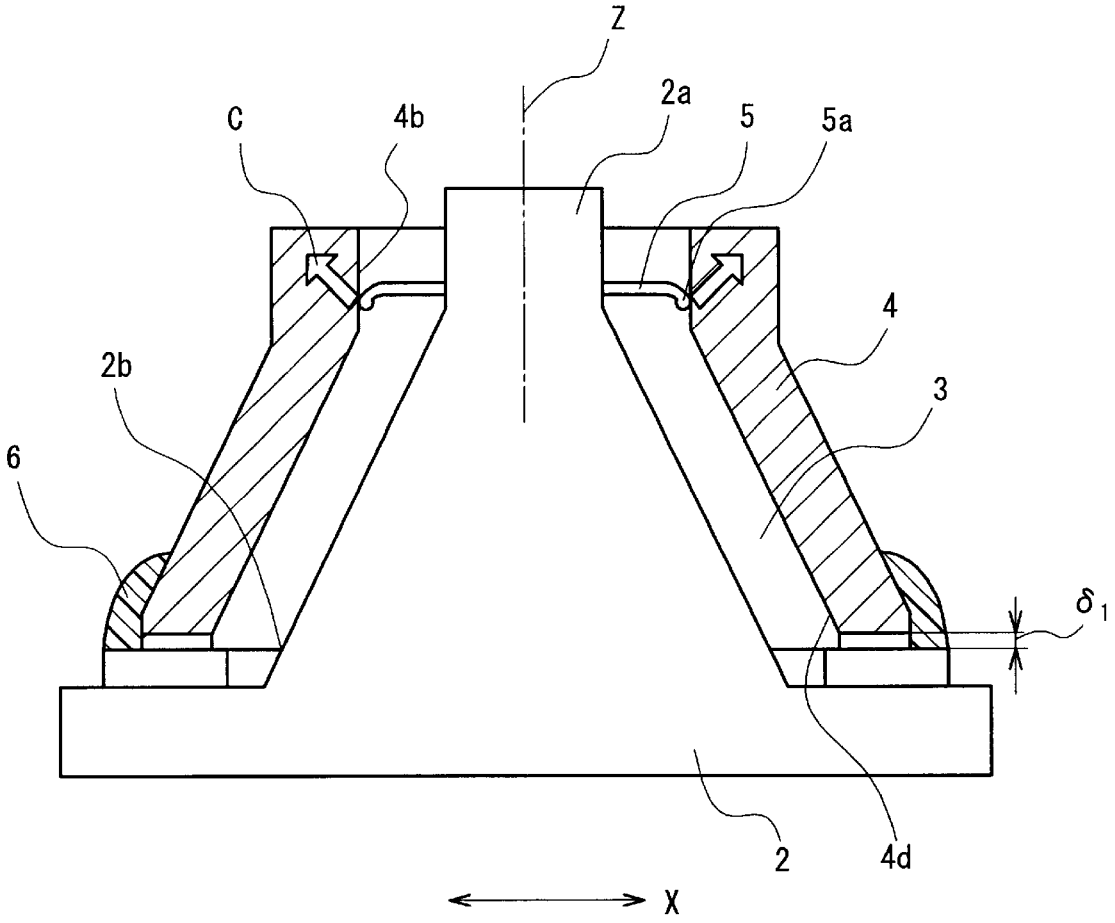
FIG. 7 (PRIOR ART)
FIG. 7 is a cross-sectional view of another conventional deflection yoke cut on a plane including a horizontal axis and a tube axis.
Figure 8:
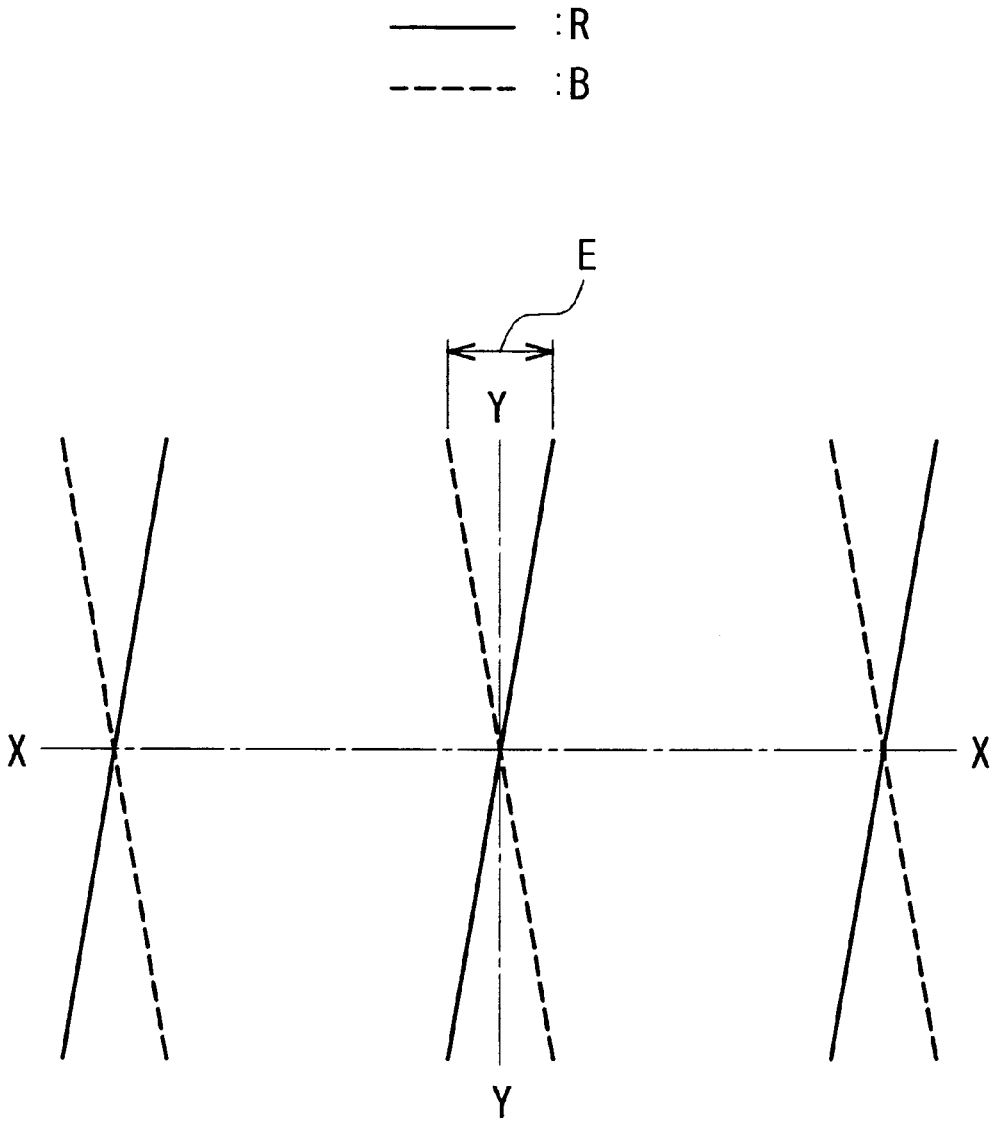
FIG. 8 is a diagram showing YH crossed misconvergence.

The following description is directed to an example in which effects of the present invention were confirmed For each of the deflection yoke of the present invention as shown in FIG. 1 and a conventional deflection yoke (a deflection yoke obtained by removing the elastic projections 21*a* and 21*b* from the deflection yoke of the present invention as shown in FIG. 1) as shown in FIG. 5, twenty samples were manufactured. Each of the deflection yokes was fitted to a common 46 cm color cathode ray tube for a computer monitor, and for each of the twenty samples, YH crossed misconvergence (hereinafter referred to as "YHc") was determined. An average of a YHc width of the twenty samples was determined and used as a YHc variation width. The YHc width is defined as a maximum distance E in a horizontal direction between an R (red) trajectory and a B (blue) trajectory as shown in FIG. 8 in a peripheral portion of a panel on a vertical axis Y.

In the case where the deflection yoke of the present invention was used, the YHc variation width was about 100 $\mu$m, while in the case where the conventional deflection yoke was used, the YHc variation width was about 350 $\mu$m. That is, the YHc variation width of a color cathode ray tube device using the deflection yoke of the present invention could be reduced to about ½ of a value of 200 $\mu$m that is permissible from the practical viewpoint and about ⅓ of a value in the case of a color cathode ray tube device using the conventional deflection yoke. This leads to a conclusion that a yield of a deflection yoke with respect to YHc variation width also can be improved.

Figure 9:
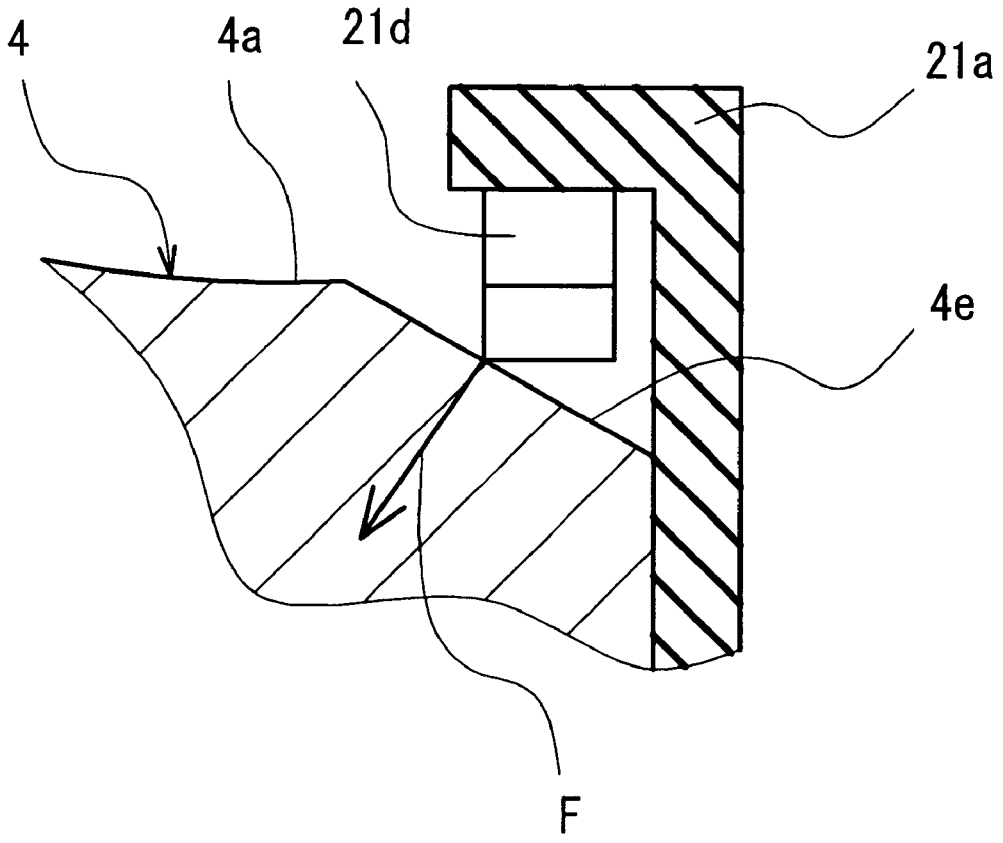
FIG. 9 is a fragmentary expanded sectional view showing another configuration of an outer wall of a minor diameter portion of the deflection yoke according to the present invention.

In the present invention, the tapered portion 4*e* of the outer wall 4*a* of the minor diameter portion of the ferrite core 4 may be at least a portion having a diameter decreasing in a direction towards the end side of the minor diameter portion. Accordingly, as in the above description, the tapered portion 4*e* may be configured as a portion formed continuously with a surface of the outer wall of the ferrite core 4 having the general shape of a surface of a conical frustum. However, the tapered portion of the present invention is not always required to have this configuration. For example, as shown in FIG. 9, the tapered portion 4*e* may be configured as a portion formed discontinuously with the surface of the outer wall of the ferrite core 4 in an end portion of the outer wall 4*a* of the minor diameter portion of the ferrite core 4. According to this configuration, the magnitude of a component of an elastic pressing force F exerted by the elastic projections 21*a* and 21*b* in a direction parallel to a direction of the tube axis Z can be set desirably by changing a cone angle of the tapered portion 4*e*.

Furthermore, although in the deflection yoke as described above, the tapered portion 4*e* is formed on the outer wall 4*a* of the minor diameter portion of the ferrite core 4, the formation of the tapered portion 4*e* is not necessarily required. When the tapered portion 4*e* is not formed, the outer wall 4*a* of the minor diameter portion of the ferrite core 4 has an outer diameter that is substantially constant in a direction of the tube axis Z. In this case, the elastic projections 21 apply an elastic pressing force F to the outer wall 4*a* of the minor diameter portion of the ferrite core 4 in a direction substantially orthogonal to the tube axis Z. Therefore, positioning accuracy of the ferrite core 4 in the direction of the tube axis Z is decreased compared with that in the aforementioned embodiment, while a center of the minor diameter portion of the ferrite core 4 is held so as to be positioned on the tube axis Z as in the above description. Thus, in this case, the generation of YH crossed misconvergence can be inhibited compared with that in the case of using the conventional deflection yoke.

Furthermore, in the deflection yoke as described above, the bent portions 21*d* are obtained by molding resin integrally with the elastic projections 21. However, the bent portions 21*d* may be configured as leaf springs formed by bending metal plates and integrated with the elastic projections 21*a* and 21*b* in the process of being molded out of resin.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A deflection yoke comprising a horizontal deflection coil, an insulation frame, a vertical deflection coil, and a ferrite core that are arranged in this order outwardly, wherein on an outer wall of a minor diameter portion of the insulation frame, a plurality of elastic projections are provided that are arranged in a standing condition and hold the ferrite core by applying a pressing force toward a tube axis to an outside surface of a minor diameter portion of the ferrite core.

2. The deflection yoke according to claim 1, wherein on the outer wall of the minor diameter portion of the ferrite core, a tapered portion having a diameter decreasing in a direction towards an end side of the minor diameter portion is provided and held by the elastic projections.

3. The deflection yoke according to claim 1, wherein in an end portion of each of the elastic projections, a bent portion is formed that elastically hold the outer wall of the minor diameter portion of the ferrite core.

4. The deflection yoke according to claim 1, wherein the elastic projections are arranged as a pair symmetrically with respect to a plane including a horizontal axis and a tube axis when the deflection yoke is fitted to a color cathode ray tube.

5. The deflection yoke according to claim 1, wherein second projections are formed on the outer wall of the minor diameter portion of the insulation frame and are arranged symmetrically with respect to a plane including a vertical axis and the tube axis when the deflection yoke is fitted to a color cathode ray tube.

6. A color cathode ray tube device comprising the deflection yoke according to claim 1.

* * * * *